US011993987B2

(12) United States Patent
Tenorio et al.

(10) Patent No.: US 11,993,987 B2
(45) Date of Patent: May 28, 2024

(54) GOOSENECK CONNECTOR SYSTEM

(71) Applicant: Schlumberger Technology Corporation, Sugar Land, TX (US)

(72) Inventors: Harold Tenorio, Houston, TX (US); John Zahl, Kristiansand (NO); Ross Stevenson, Houston, TX (US); Jon Tyler, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/182,461

(22) Filed: Mar. 13, 2023

(65) Prior Publication Data

US 2023/0212917 A1 Jul. 6, 2023

Related U.S. Application Data

(62) Division of application No. 17/248,763, filed on Feb. 5, 2021, now Pat. No. 11,603,718.

(60) Provisional application No. 62/970,994, filed on Feb. 6, 2020.

(51) Int. Cl.

| | |
|---|---|
| ***E21B 33/038*** | (2006.01) |
| ***E21B 17/02*** | (2006.01) |
| ***E21B 17/08*** | (2006.01) |
| ***E21B 19/12*** | (2006.01) |
| ***E21B 19/16*** | (2006.01) |
| ***E21B 19/24*** | (2006.01) |

(52) U.S. Cl.

CPC ..... *E21B 19/12* (2013.01); *E21B 17/02* (2013.01); *E21B 17/0853* (2020.05); *E21B 19/16* (2013.01); *E21B 19/24* (2013.01); *E21B 33/038* (2013.01)

(58) Field of Classification Search

CPC ..... E21B 19/12; E21B 19/24; E21B 19/16; E21B 17/02; E21B 33/038; E21B 33/03; E21B 33/035

See application file for complete search history.

(56) References Cited

U.S. PATENT DOCUMENTS

| | | | | |
|---|---|---|---|---|
| 4,878,694 | A | 11/1989 | Castel | |
| 5,314,024 | A | 5/1994 | Rodgers | |
| 9,719,310 | B2 * | 8/2017 | MacGregor | E21B 17/01 |

(Continued)

*Primary Examiner* — Taras P Bemko

(74) *Attorney, Agent, or Firm* — Kelly McKinney

(57) ABSTRACT

A gooseneck conduit assembly includes a gooseneck conduit including a vertically-extending portion, an upset formed on the vertically-extending portion, an alignment key extending laterally from the vertically-extending portion, and a lower coupling at a lower end of the vertically-extending portion; a second conduit configured to connect to an auxiliary fluid line connected to and extending along a riser string that extends to a subsea wellhead, the second conduit including a receiving end configured to form a connection with the lower coupling; and a frame configured to be connected to the riser string. The frame includes an upper bracket vertically offset from a lower bracket to which the second conduit is secured, an alignment groove configured to slidably receive the alignment key so as to maintain a coaxial alignment between the vertically-extending portion of the gooseneck conduit and the second conduit, and a locking member pivotally coupled to the upper bracket.

9 Claims, 9 Drawing Sheets

(56) References Cited

U.S. PATENT DOCUMENTS

| | | | | |
|---|---|---|---|---|
| 10,947,796 | B2 * | 3/2021 | Walker | E21B 21/01 |
| 2011/0056701 | A1 * | 3/2011 | Jones | E21B 17/046<br>166/356 |
| 2011/0101682 | A1 * | 5/2011 | Vatne | E21B 33/038<br>285/308 |
| 2012/0325486 | A1 | 12/2012 | Gilmore | |
| 2013/0092388 | A1 | 4/2013 | Gilmore | |
| 2014/0083711 | A1 | 3/2014 | Springett | |
| 2016/0230480 | A1 | 8/2016 | Jansen | |
| 2022/0098935 | A1 | 3/2022 | Stephen | |

* cited by examiner

GOOSENECK CONNECTOR SYSTEM

CROSS-REFERENCE TO RELATED APPLICATIONS

This application claims priority as a divisional application of U.S. Pat. No. 11,603,718, which claims priority to U.S. Provisional Patent Application Ser. No. 62/970,994, filed Feb. 6, 2020, which are incorporated by reference herein in their entirety.

BACKGROUND

Marine wellbore drilling and production includes locating a drilling and/or production unit on a platform at the surface of a body of water. A surface casing may extend from proximate the water bottom to a selected depth into the formations below the water bottom. A valve system ("wellhead") may be coupled to the top of the surface casing proximate the water bottom. A blowout preventer stack might be secured to the wellhead housing's upper end. A blowout preventer stack is an assemblage of blowout preventers and valves used to control wellbore pressure. The upper end of the blowout preventer stack has an end connection or riser adapter (often referred to as a lower marine riser package or LMRP) that allows the blowout preventer stack to be connected to a series of pipes, known as riser, riser string, or riser pipe. Each segment of the riser string is connected in end-to-end relationship, allowing the riser string to extend upwardly to the drilling/production rig or platform positioned over the wellhead housing.

The riser string is supported at the ocean surface by the drilling rig. This support takes the form of a hydraulic tensioning system and telescoping (slip) joint that connect to the upper end of the riser string and maintain tension on the riser string. The telescoping joint is composed of a pair of concentric pipes, known as an inner and outer barrel, that are axially telescoping within each other. The lower end of the outer barrel connects to the upper end of the aforementioned riser string. The hydraulic tensioning system connects to a tension ring secured on the exterior of the outer barrel of the telescoping joint and thereby applies tension to the riser string. The upper end of the inner barrel of the telescoping joint is connected to the drilling platform. The axial telescoping of the inner barrel within the outer barrel of the telescoping joint compensates for relative elevation changes between the rig and wellhead housing as the rig moves up or down in response to the ocean waves.

According to conventional practice, various auxiliary fluid lines are coupled to the exterior of the riser tube. Exemplary auxiliary fluid lines include choke, kill, booster, and clean water lines.

Choke and kill lines typically extend from the drilling rig to the wellhead to provide fluid communication for well control and circulation. While the auxiliary lines provide pressure control means to supplement the hydrostatic control resulting from the fluid column in the riser, the riser tube itself provides the primary fluid conduit to the surface. In some applications, the drilling system may use managed pressure drilling ("MPD") to drill through a water bottom made of softer materials (i.e., materials other than only hard rock). Managed pressure drilling regulates the pressure and flow of mud flowing through an inner drill string, so that the mud flow into the well does not over pressurize the well (i.e., expand the well) or allow the well to collapse under its own weight, for example. The ability to manage the drill mud pressure therefore enables drilling of mineral reservoirs in various locations, including locations with softer sea beds.

A hose or other fluid line connection to each auxiliary fluid line coupled to the exterior of the riser tube is provided at the telescoping joint via a pipe or equivalent fluid channel. The pipe is often curved or U-shaped, and is accordingly termed a "gooseneck" conduit. In the course of drilling operations, a gooseneck conduit may be detached from the riser, for example, for maintenance or to permit the raising of the riser through the drilling floor, and reattached to the riser to provide access to the auxiliary fluid lines. The gooseneck conduits are typically coupled to the auxiliary fluid lines via threaded connections.

SUMMARY

This summary is provided to introduce a selection of concepts that are further described below in the detailed description. This summary is not intended to identify key or essential features of the claimed subject matter, nor is it intended to be used as an aid in determining or limiting the scope of the claimed subject matter as set forth in the claims.

Embodiments of the disclosure include a connector system having a first conduit having a lower coupling and a first alignment feature, and a frame configured to be coupled to an oilfield tubular, and configured to receive the first conduit and a second conduit. The frame includes a second alignment feature configured to mate with the first alignment feature such that the lower coupling is aligned with the second conduit, and the first alignment feature is configured to slide vertically with respect to the second alignment feature such that the lower coupling is brought into engagement with the second conduit while the first and second alignment features are mated together.

Embodiments of the disclosure also include a method for connecting together a first conduit and a second conduit. The method includes connecting the second conduit to a frame, connecting the frame to an oilfield tubular, moving the first conduit laterally to a position that is vertically above the second conduit supported in the frame, and lowering the first conduit toward the second conduit. Lowering the first conduit comprises mating a first alignment feature of the first conduit with a second alignment feature of the second conduit. The mated first and second alignment features maintain coaxial alignment between the first and second conduits while lowering the first conduit toward the second conduit. The method also includes locking a position of the first conduit, after lowering the second conduit, by moving a locking member to a closed position, so as to prevent the first conduit from displacement relative to the second conduit, without forming a threaded connection between the first and second conduits.

Embodiments of the disclosure further include a gooseneck conduit assembly for a riser string. The assembly includes a gooseneck conduit having a vertically-extending portion, an upset formed on the vertically-extending portion, an alignment key extending laterally from the vertically-extending portion, and a lower coupling at a lower end of the vertically-extending portion. The assembly also includes a second conduit configured to connect to an auxiliary fluid line connected to and extending along a riser string that extends to a subsea wellhead, the second conduit including a receiving end configured to form a connection with the lower coupling. The assembly further includes a frame configured to be connected to the riser string. The frame includes a lower bracket to which the second conduit is secured, an upper bracket that is vertically offset from the lower bracket and defines an opening therethrough that is configured to laterally receive the vertically-extending portion of the gooseneck conduit. The upper bracket is configured to engage a lower engaging surface of the upset. The frame also includes an alignment groove configured to slidably receive the alignment key so as to maintain a coaxial alignment between the vertically-extending portion of the gooseneck conduit and the second conduit. The frame further includes a locking member pivotally coupled to the upper bracket. The locking member is pivotal between an open position that permits the opening to laterally receive the vertically-extending portion, and a closed position in which the locking member prevents lateral movement of the vertically-extending portion of the gooseneck conduit with respect to the frame, and engages the upset so as to prevent upward movement of the gooseneck conduit with respect to the second conduit, such that a connection between the lower coupling of the gooseneck conduit and the receiving end of the second conduit is maintained without forming a threaded connection therebetween.

BRIEF DESCRIPTION OF THE DRAWINGS

For a detailed description of exemplary embodiments, reference will now be made to the accompanying drawings in which.

DETAILED DESCRIPTION

Figure 1:
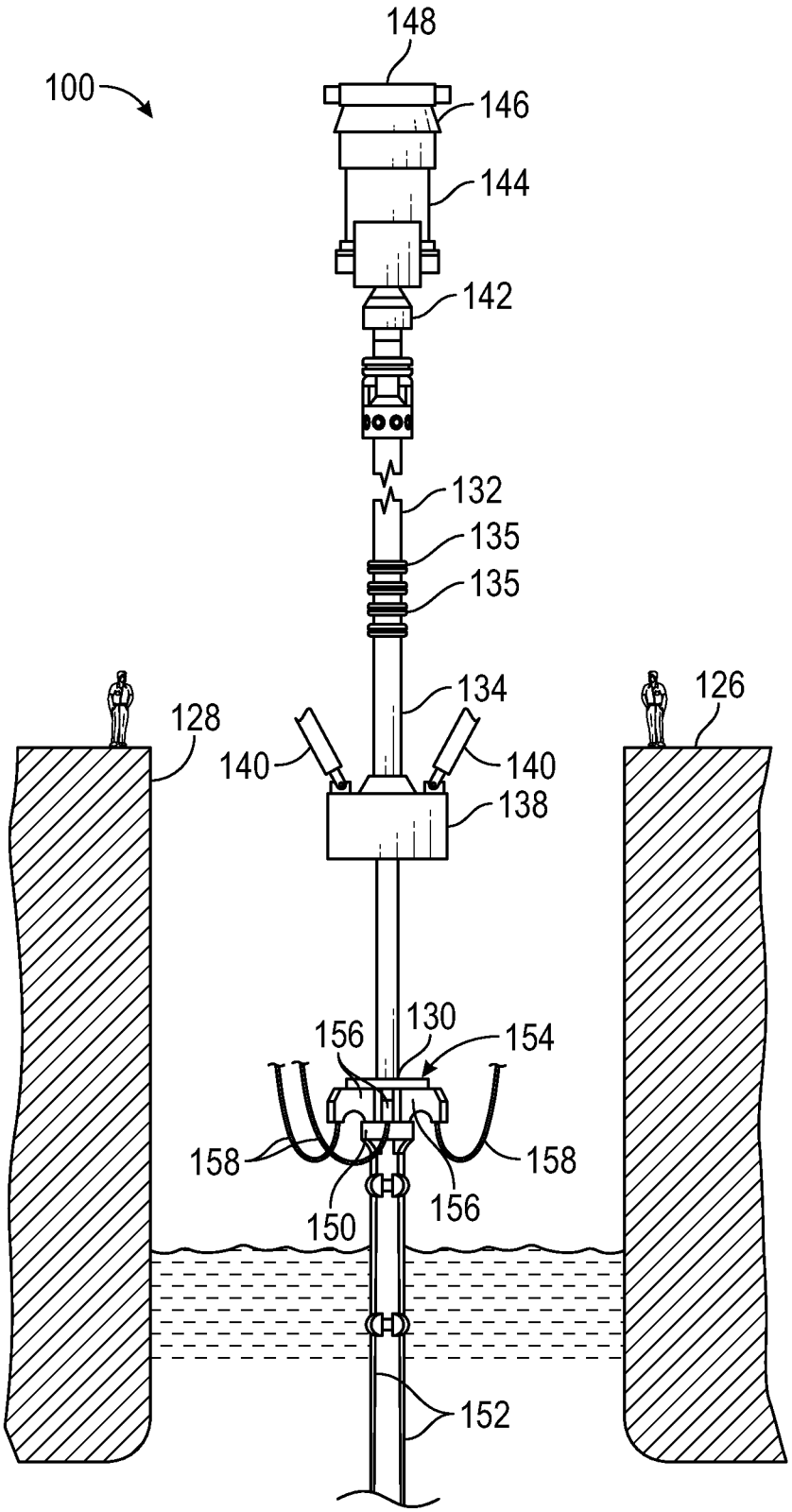
FIGS. 1 and 2 illustrate side views of a drilling system including a connector system, according to an embodiment.

In the drawings and description that follow, like parts are typically marked throughout the specification and drawings with the same reference numerals. The drawing figures are not necessarily to scale. Certain features of the disclosed embodiments may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed below may be employed separately or in any suitable combination to produce desired results.

Unless otherwise specified, in the following discussion and in the claims, the terms "including" and "comprising" are used in an open-ended fashion, and thus should be interpreted to mean "including, but not limited to . . . ". Any use of any form of the terms "connect", "engage", "couple", "attach", or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

The size and weight of the gooseneck conduits, and the location of the attachment points of the conduits to the telescoping joint and the auxiliary fluid lines, makes installation and/or retrieval of the conduits a labor-intensive process. Consequently, gooseneck conduit handling operations can be time consuming and costly. Embodiments of the present disclosure include a gooseneck conduit system that reduces handling time and enhances operational safety. Embodiments of the conduit system disclosed herein can provide simultaneous connection of gooseneck conduits to a plurality of auxiliary fluid lines with no requirement for manual handling or connection operations. Embodiments include locking mechanisms that secure the conduit system to the telescoping joint and the auxiliary fluid lines. The conduit system may be hoisted into position on the telescoping joint, and attached to the telescoping joint and the auxiliary fluid lines via the provided locking mechanisms. Thus, embodiments allow gooseneck conduits to be quickly and safely attached to and/or removed from the telescoping joint. Additionally, it shall be recognized that embodiments of the disclosure may provide for connections between a gooseneck and a slip joint, or any other drilling tubular with an open conduit line within its length, for example of a riser string that is then locked into position by a gate of sorts.

Figure 2:
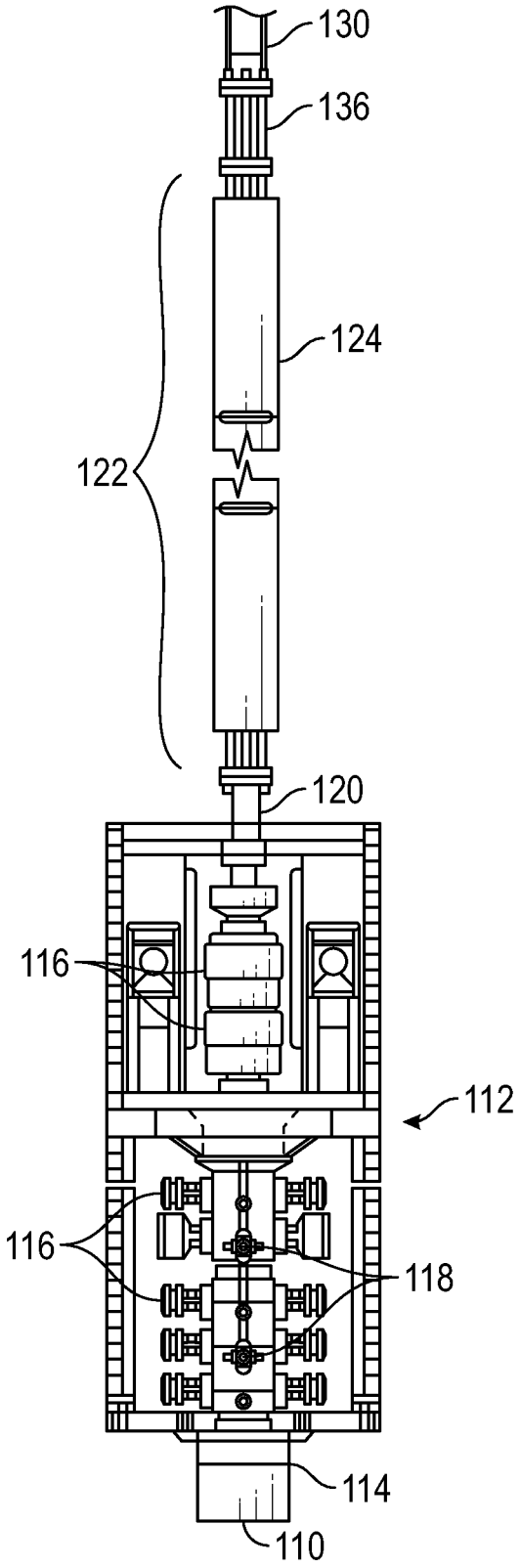

FIGS. 1 and 2 illustrate side views of a drilling system 100, according to an embodiment. The drilling system 100 includes a drilling rig 126 with a riser string 122 and blowout preventer stack 112 used in oil and gas drilling operations connected to a wellhead housing 110. The illustrated drilling system 100 can be configured to carry out drilling operations with or without managed pressure drilling capabilities. In some embodiments, the drilling system 100 might be land-based (e.g., a surface system) or subsea (e.g., a subsea system). As illustrated, the wellhead housing 110 is disposed on the ocean floor with blowout preventer stack 112 connected thereto by hydraulic connector 114. The blowout preventer stack 112 includes multiple blowout preventers 116 and kill and choke valves 118 in a vertical arrangement to control wellbore pressure in a manner known to those skilled in the art. Disposed on the upper end of blowout preventer stack 112 is riser adapter 120 to allow connection of the riser string 122 to the blowout preventer stack 112. The riser string 122 is composed of multiple sections of pipe or riser joints 124 connected end to end and extending upwardly to drilling rig 126.

In the illustrated example, the drilling rig 126 further includes moon pool 128 having telescoping joint 130 disposed therein. Telescoping joint 130 includes inner barrel 132 which telescopes inside outer barrel 134 to allow relative motion between drilling rig 126 and wellhead housing 110. Dual packer 135 is disposed at the upper end of outer barrel 134 and seals against the exterior of inner barrel 132. Landing tool adapter joint 136 is connected between the upper end of riser string 122 and outer barrel 134 of telescoping joint 130. Tension ring 138 is secured on the exterior of outer barrel 134 and connected by tension lines 140 to a hydraulic tensioning system as known to those skilled in the art. This arrangement allows tension to be applied by the hydraulic tensioning system to tension ring 138 and telescoping joint 130. The tension is transmitted through landing tool adapter joint 136 to riser string 122 to support the riser string 122. The upper end of inner barrel 132 is terminated by flex joint 142 and diverter 144 connecting to gimbal 146 and rotary table spider 148.

A support collar or "frame" 150 is coupled to the telescoping joint 130, and the auxiliary fluid lines 152 are terminated at seal subs retained by the support collar 150. One or more gooseneck conduit assemblies 154 are coupled to the support collar 150 and to the auxiliary fluid lines 152 via the seal subs retained by the support collar 150. Each conduit assembly 154 is a conduit unit that includes one or more gooseneck conduits 156. A hose 158 or other fluid line is connected to each gooseneck conduit 156 for transfer of fluid between the gooseneck conduit 156 and the drilling rig 126. In some embodiments, the connections between the hoses 158 and/or other rig fluid lines and the gooseneck conduits 156 are made on the rig floor, and thereafter the gooseneck conduit assembly 154 is lowered onto the telescoping joint 130.

Figure 3:
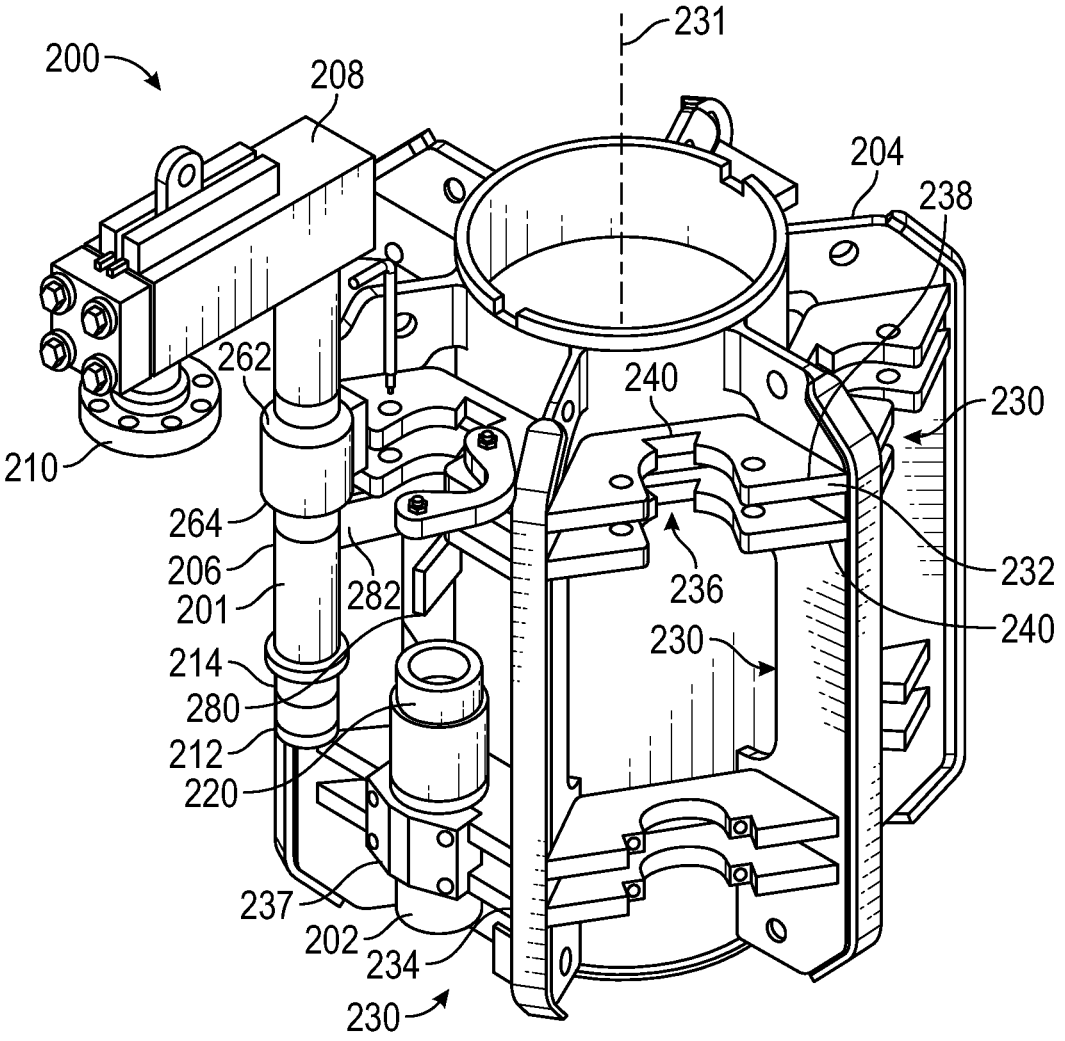
FIG. 3 illustrates a perspective view of a gooseneck conduit assembly in a separated configuration, according to an embodiment.
Figure 4:
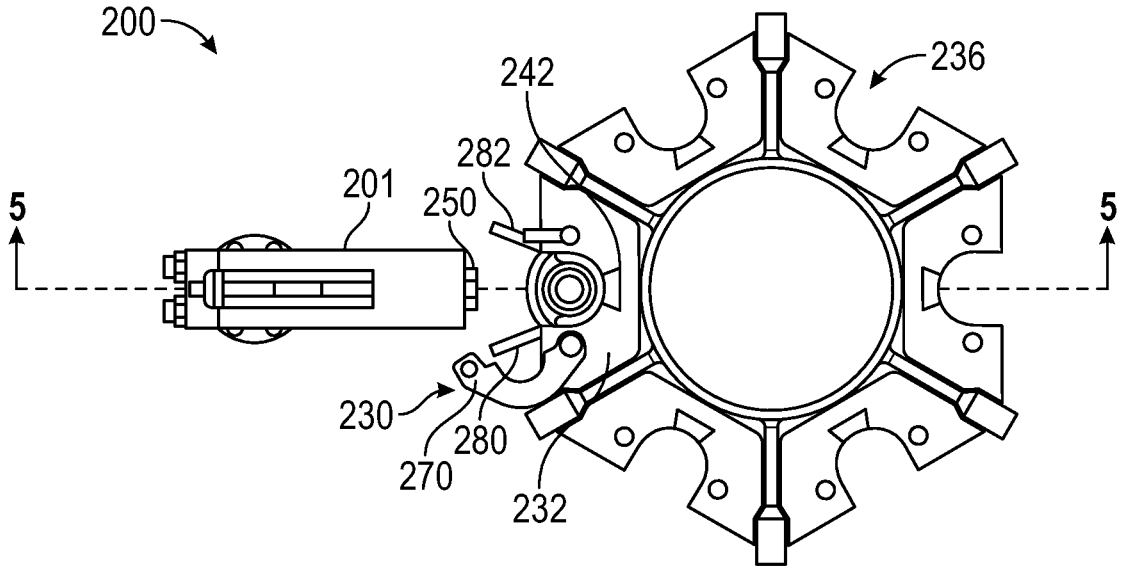
FIG. 4 illustrates a top view of the gooseneck conduit assembly in the separated configuration, according to an embodiment.
Figure 5:
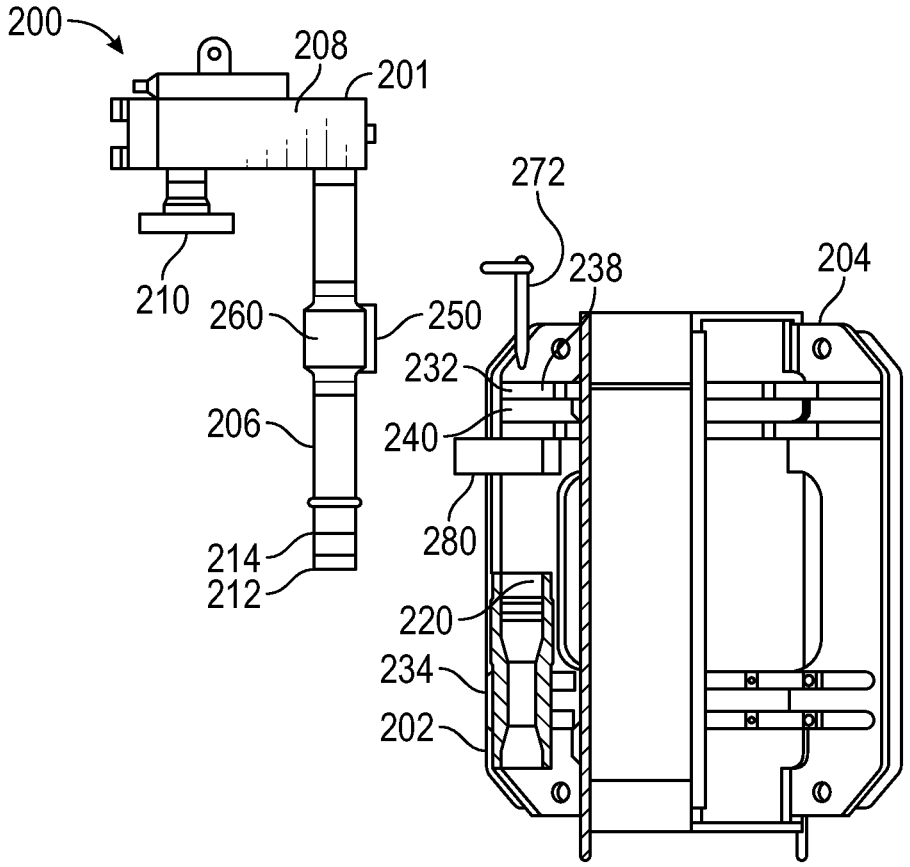
FIG. 5 illustrates a cross-sectional side view along line 5-5 of FIG. 4, according to an embodiment.

FIG. 3 illustrates a perspective view of a connector system, specifically a gooseneck conduit assembly 200, which may provide an example of the gooseneck conduit assembly 154 discussed above, according to an embodiment. FIG. 4 illustrates a top view of the gooseneck conduit assembly 200, according to an embodiment. FIG. 5 illustrates a cross-sectional view of the gooseneck conduit assembly 200, according to an embodiment. Referring to FIGS. 1-3, the conduit assembly 200 includes a first conduit 201, a second conduit 202, and a frame 204. The first conduit 201 is separated from the second conduit 202 in these three views, and may be lifted, e.g., using a crane into the illustrated position. The frame 204 may be connected to an oilfield tubular, e.g., a telescoping joint 130, a riser string 122, etc. As mentioned above, the second conduit 202 may be a seal sub, and may be connected to the auxiliary fluid line 152 that is coupled to the riser string 122 and extends to or at least toward a wellhead 110, e.g., at the ocean floor.

In a specific embodiment, the first conduit 201 may be a gooseneck conduit. For example, as shown, the first conduit 201 may include a vertically-extending portion 206 and a laterally-extending portion 208. Although shown forming a generally 90-degree angle therebetween, it will be appreciated that the portions 206, 208 may define any non-zero angle or may be curved together. At an end that is away from the vertically-extending portion 206, the laterally-extending portion 208 may include a flange 210 or another connection, e.g., pointing downward, as shown, which may be configured to connect to a hose 158 (FIG. 1). At an end that is away from the laterally extending portion 208, the vertically-extending portion 206 may include a lower coupling 212. The lower coupling 212 may be shaped, e.g., tapered, so as to provide a stabbing geometry for receipt into a female end of the second conduit 202, as will be described in greater detail below. The lower coupling 212 may also include one or more seals 214, e.g., o-rings, positioned therearound. The lower coupling 212 may further include a shoulder 216 spaced apart from the lower end. In at least some embodiments, the lower coupling 212 may not be threaded.

The second conduit 202 may be configured to be connected to the first conduit 201, e.g., without forming or otherwise using a threaded connection therebetween. This may, for example, avoid the use of manual tools (e.g., wrenches) to connect together the first and second conduits 201, 202. In an embodiment, the second conduit 202 may include an upper receiving end 220, which may be configured to receive the stabbing geometry of the lower coupling 212, and to seal therewith, e.g., via the seals 214 engaging an inner diameter surface of the second conduit 202. The upper receiving end 220 may not be threaded.

The frame 204 may include a plurality of coupling modules 230 (six are visible) that are positioned at angular intervals around a center (e.g., central axis) 231 of the frame 204. The coupling modules 230 may each be configured to receive and connect together a pair of conduits, e.g., the first and second conduits 201, 202 described above. Accordingly, the coupling modules 230 will be discussed herein with respect to the illustrated instance of the first and second conduits 201, 202 being connected together within one of the coupling modules 230, with it being appreciated that two or more (e.g., each) of the coupling modules 230 may be employed to connect together separate pairs of conduits.

The coupling module 230 may include a first or "upper" bracket 232 that is configured to receive and support the first conduit 201, and a second or "lower" bracket 234 that is configured to receive and support, e.g., secure to, the second conduit 202. In at least some embodiments, the second conduit 202 may be fixed in position with respect to the frame 204, e.g., fastened thereto as shown, by a clamp 237. The upper and lower brackets 232, 234 may be spaced axially (along the central axis 231, e.g., vertically) apart. The upper bracket 232 may include an opening 236, which may be open-ended, permitting the first conduit 201 to be moved laterally into the opening 236. In other embodiments, the opening 236 may be a closed, circular hole, permitting vertical but not lateral access to the opening 236, such that the first conduit 201 may be lowered into the opening 236. In a specific embodiment, the upper bracket 232 may include a first plate 238 and a second plate 240, which may be separated axially (vertically) apart, with the opening 236 being defined through both.

The upper bracket 232 may also include an alignment feature 242. In this illustration, the alignment feature 242 is a groove that is formed in and through the first and second plates 238, 240. In other embodiments, the alignment feature 242 may be a hole, a post, a rail, etc. The first conduit 201 also includes an alignment feature 250. The alignment features 242, 250 may be configured to mate together, and may be able to slide relative to one another, so as to permit vertical movement of the first conduit 201 relative to the frame 204, and thus the second conduit 202 secured thereto, while the features 242, 250 are mated together. The mated alignment features 242, 250 may prevent lateral displacement of the first conduit 201 relative to the second conduit 202 while the first conduit 201 is being lowered. In a specific embodiment, the alignment feature 250 is a key that extends laterally from the first conduit 201 and is configured to slide into the groove provided by the alignment feature 242. In other embodiments, the alignment feature 250 may be a post, groove, rail, etc., e.g., so as to mate with the alignment feature 242. In a specific embodiment, the alignment features 242, 250 may mate together to form a dovetail joint.

The first conduit 201 may also include an upset 260 on the vertically-extending portion 206. The upset 260 may be a collar or an area where a wall thickness of the first conduit 201 is changed (e.g., increased) such that it extends radially (e.g., outward) from adjacent areas of the vertically-extending portion 206. The upset 260 may provide a first or "upper" engaging surface 262 and a second or "lower" engaging surface 264, which are separated axially apart along the vertically-extending portion 206. The lower engaging surface 264 may be configured to land on the upper bracket 232, specifically the second plate 240, so as to transfer at least some of the weight of the first conduit 201 to the frame 204.

The frame 204 may additionally include a locking member 270. The locking member 270 may be coupled to the upper bracket 232, e.g., to the first plate 238. The locking member 270 may be movable, e.g., pivotal, with respect to the frame 204. For example, the locking member 270 may be pivotal from an open position (as illustrated) in which the locking member 270 is rotated away from the open-ended opening 236, permitting lateral entry of the vertically-extending portion 206 of the first conduit 201 into the opening 236, to a closed position in which the locking member 270 at least partially blocks the open-ended opening 236. The locking member 270 in the closed position may be configured to engage the upper engaging surface 262 of the upset 260, which may prevent the first conduit 201 from being displaced vertically from the second conduit 202 in response to pressurized fluid traversing through the first and second conduits 201, 202. A pin 272 may be inserted through the locking member 270 and the upper bracket 232 to hold the locking member 270 in the closed position.

The frame 204 may further include one or more alignment plates 280, 282. The alignment plates 280, 282 may extend laterally outward of the upper bracket 232, and may be angled, relative to one another, so as to be farther apart at a distal end than at a proximal end. Accordingly, the alignment plates 280, 282 may facilitate directing the first conduit 201 as it is brought laterally toward the frame 204 into position, such that the vertically-extending portion 206 is received laterally into the opening 236.

Figure 6:
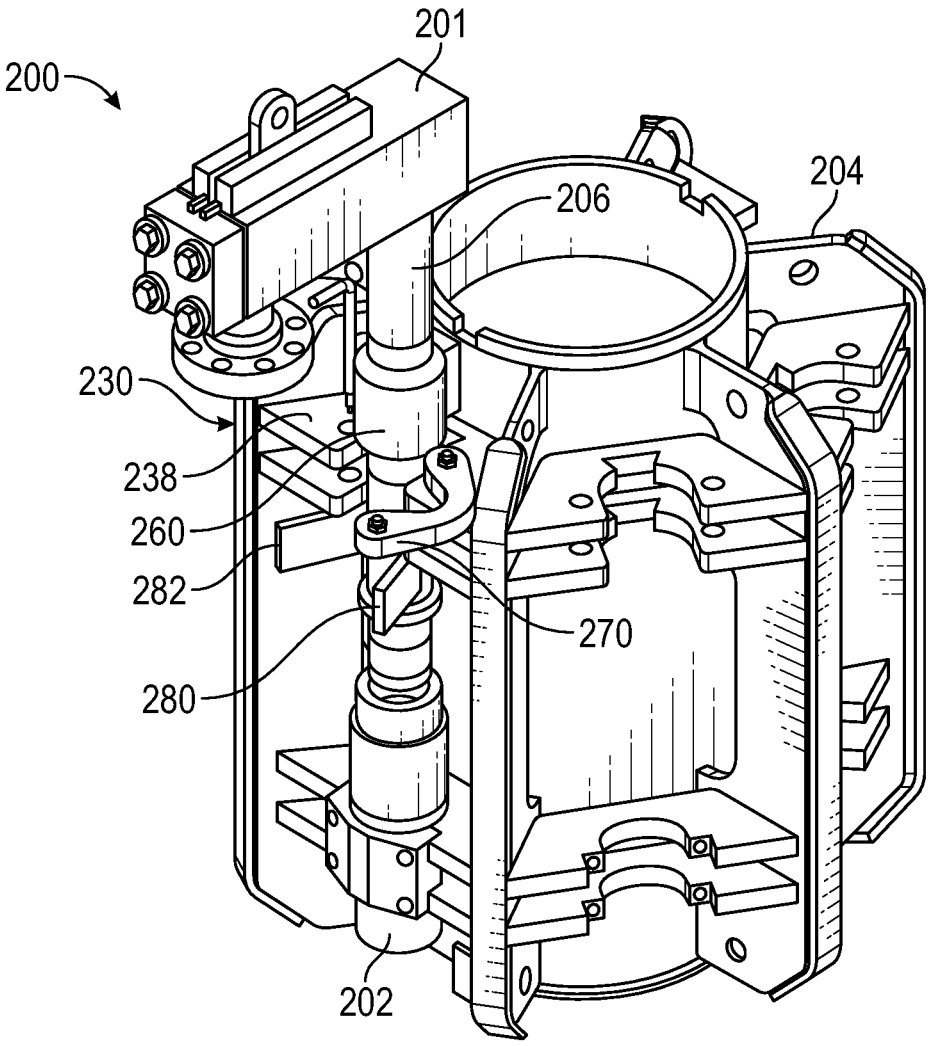
FIG. 6 illustrates a perspective view of a gooseneck conduit assembly in which the first conduit is aligned with the second conduit, according to an embodiment.
Figure 7:
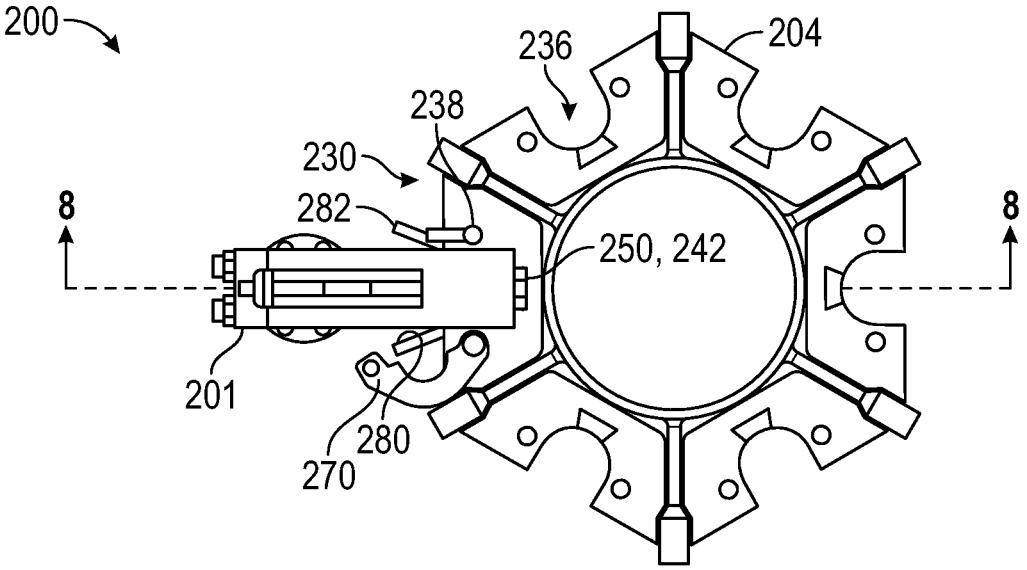
FIG. 7 illustrates a top view of the gooseneck conduit assembly in the same configuration as FIG. 6, according to an embodiment.
Figure 8:
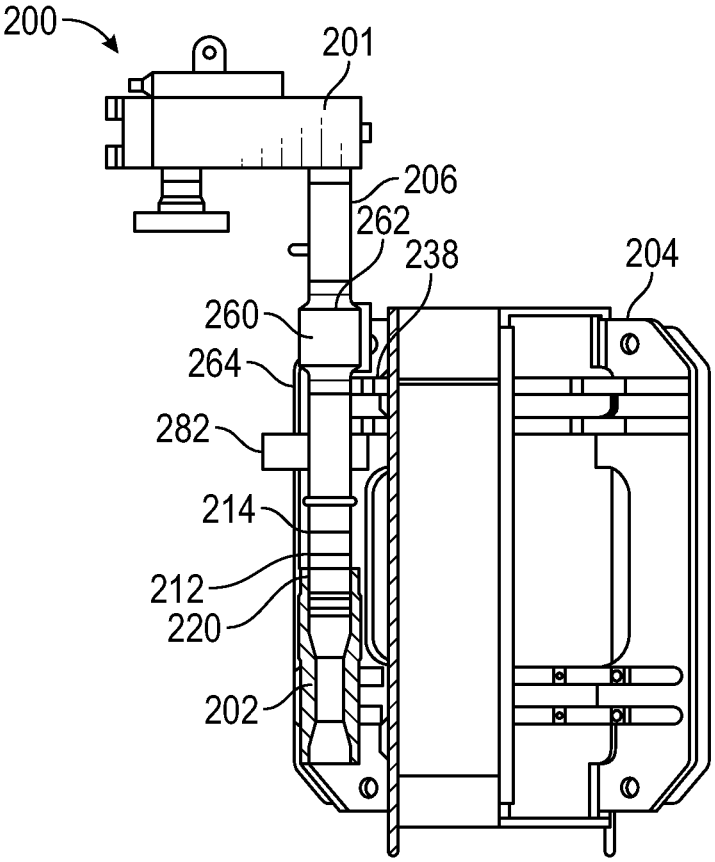
FIG. 8 illustrates a cross-sectional side view along line 8-8 of FIG. 7, according to an embodiment.

FIGS. 6, 7, and 8 illustrate views of the gooseneck conduit assembly 200, similar to FIGS. 3, 4, and 5, respectively. In FIGS. 6-8, however, the vertically-extending portion 206 of the first conduit 201 has been received laterally into the opening 236 past the locking member 270 in its open position, such that the alignment feature 250 is vertically above the alignment feature 242. In this view, the vertically-extending portion 206 is coaxial with the second conduit 202, such that lowering the first conduit 201 relative to the second conduit 202 may result in stabbing the lower coupling 212 into the receiving end 220. Additionally, the upset 260 is vertically above the upper bracket 232.

Figure 9:
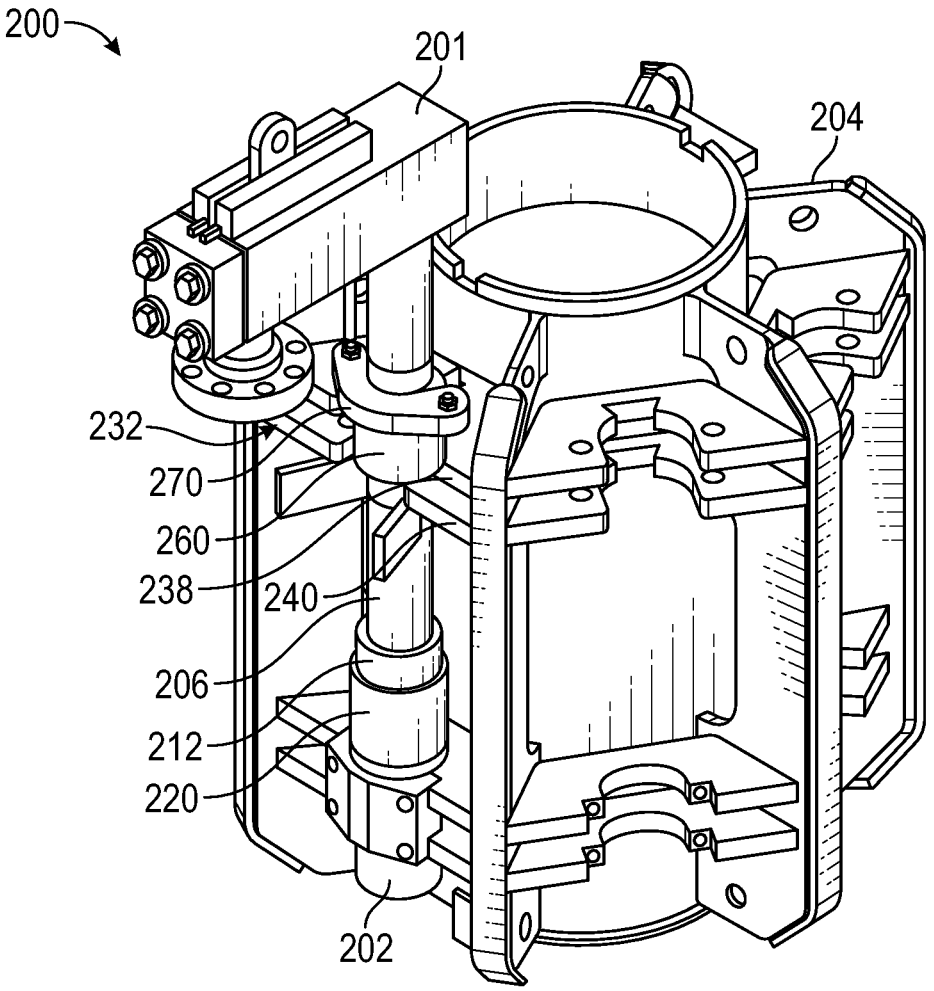
FIG. 9 illustrates a perspective view of a gooseneck conduit assembly in a connected configuration, according to an embodiment.
Figure 10:
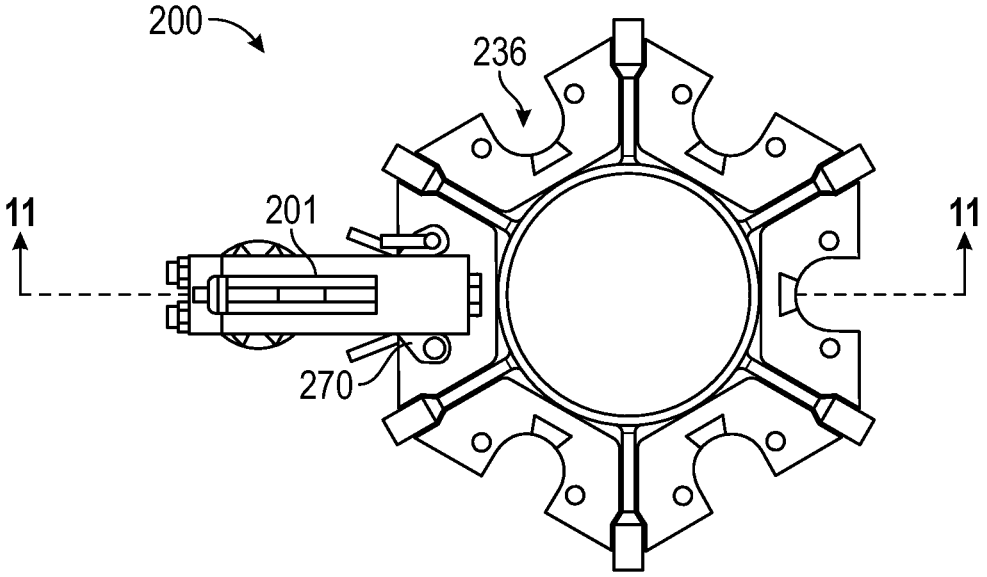
FIG. 10 illustrates a top view of the gooseneck conduit assembly in the connected configuration, according to an embodiment.
Figure 11:
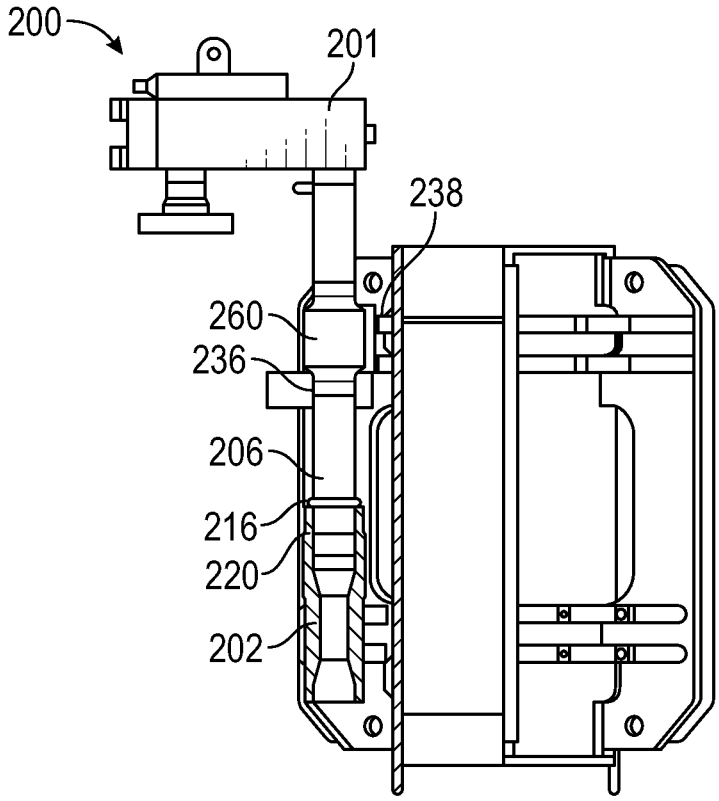
FIG. 11 illustrates a cross-sectional side view along line 11-11 of FIG. 10, according to an embodiment.

FIGS. 9, 10, and 11 illustrate views of the gooseneck conduit assembly 200, similar to FIGS. 6, 7, and 8, respectively. In FIGS. 9-11, however, the first conductor 200 has been lowered into engagement with the second conduit 202. As shown, the lower coupling 212 has been stabbed into the receiving end 220, such that the shoulder 216 rests on the axial end surface of the second conduit 202. Further, the lower engaging surface 264 of the upset 260 is resting on, and supported by, the second plate 240 of the upper bracket 232. Alignment of the first conduit 201 with the second conduit 202, which permits the stabbing of the lower coupling 212 into the receiving end 220, is maintained by the mating (e.g., slidable engagement) of the alignment features 242, 250, which are brought into engagement with one another by lowering the first conduit 201, and continue to be engaged as the first conduit 201 continues to be lowered.

Once the first and second conduits 201, 202 are stabbed together, the locking member 270 is moved (e.g., pivoted) from its open position to its closed position. In the closed position, the locking member 270 engages the upper engaging surface 262 of the upset 260, preventing the upset 260 from vertical (upward) movement and displacement of the first conduit 201 relative to the second conduit 202. Further, both the locking member 270 and the mating of the alignment features 242, 250 may prevent lateral displacement of the first conduit 201 relative to the second conduit 202, instead holding the first conduit 201 in the opening 236. As such, the first conduit 201 and the second conduit 202 are both held stationary in the frame 204 and in connection with one another. This connection may thus obviate a need for rotating threaded joints between the first and second conduits 201, 202, which may facilitate the connection process.

Figure 12:
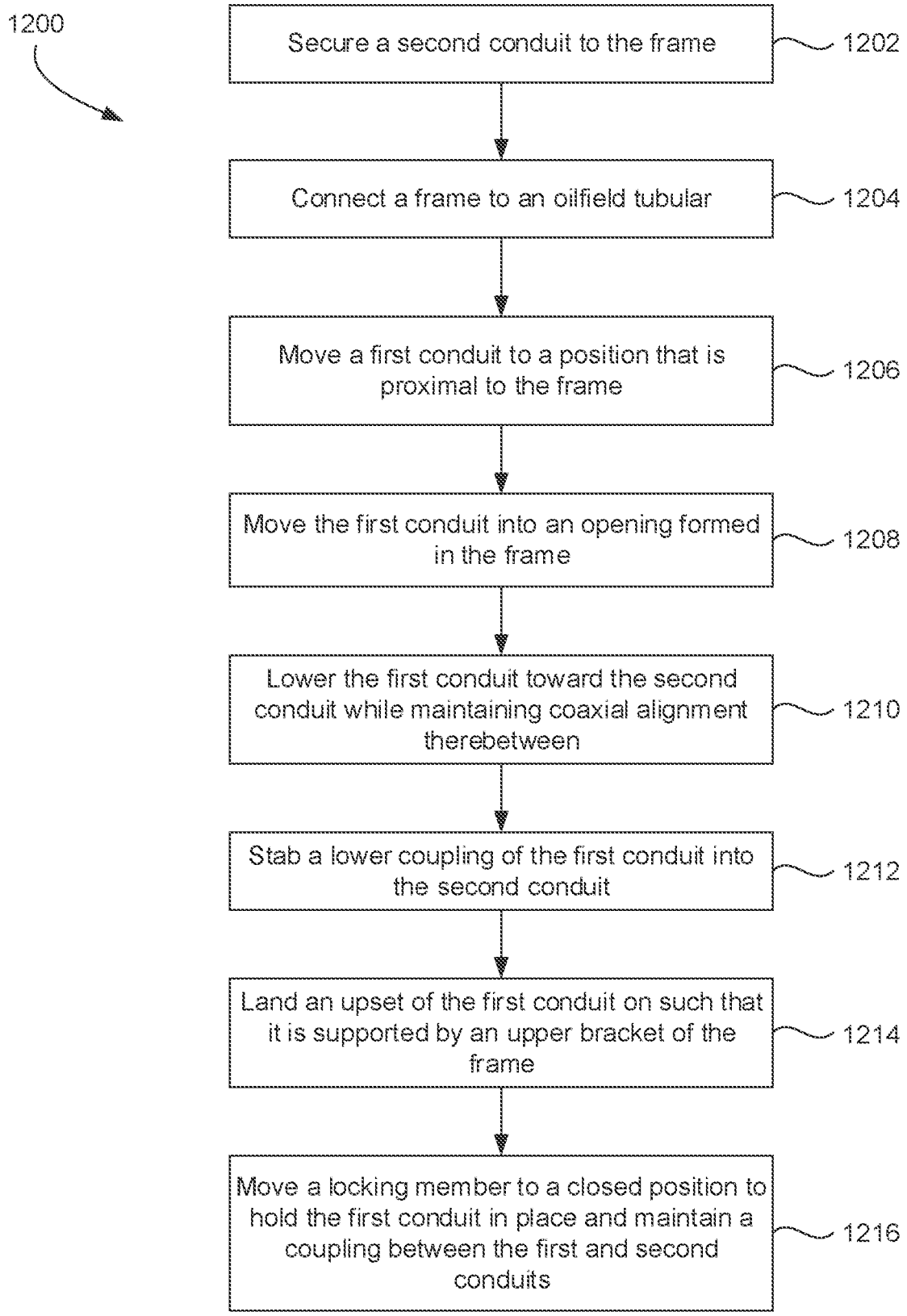
FIG. 12 illustrates a flowchart of a method for connecting a first conduit and a second conduit in a gooseneck conduit assembly, according to an embodiment.

FIG. 12 illustrates a flowchart of a method 1200 for connecting a first conduit 201 of a gooseneck conduit assembly 200 to a second conduit 202 of the assembly 200, according to an embodiment. The method 1200 may proceed by operation of the gooseneck conduit assembly 200 discussed above, and is thus described herein by reference thereto; however, it will be appreciated that other embodiments of the method 1200 may employ other structures. Further, individual aspects of the method 1200 may be performed in the order and in the manner presented below, in a different order, combined, conducted in parallel, or separated, without departing from the scope of the present disclosure.

The method 1200 may include securing the second conduit 202 to a frame 204, with the second conduit 202 being configured to be coupled to an auxiliary fluid line 152 that extends along the riser string 122, as at 1202. The second conduit 202 may be rigidly secured to the frame 204, e.g., via a clamp 237. Before, during, or after securing at 1202, the method 1200 may include connecting the frame 204 to (e.g., around) an oilfield tubular, such as a telescoping joint 130 connected to a riser string 122, as at 1202.

The method 1200 may then include moving (e.g., lifting, hoisting) a first conduit 201, which may be a gooseneck conduit, to a position that is proximal to the frame 204, as at 1206. This position is shown in FIGS. 3-5. As shown in FIGS. 6-8, the first conduit 201 may then be moved (e.g. laterally) such that a vertically-extending portion 206 of the first conduit 201 is received into an opening 236 formed in an upper bracket 232 of the frame 204, as at 1208. During such movement, one or more alignment plates 280, 282 of the frame 204 may direct the first conduit 201 into the opening 236.

The first conduit 201 may then be lowered relative to the frame 204, as at 1210. During such lowering, alignment features 242, 250 of the frame 204 and the first conduit 201 may be mated together. The alignment features 242, 250, e.g., a dovetail key-and-groove connection, may permit the first conduit 201 to be moved vertically relative to the frame 204, while maintaining the lateral position of the first conduit 201 with respect to the frame 204. In this way, the vertically-extending portion 206 of the first conduit 201 may be held in coaxial alignment with the second conduit 202.

The lowering may result in a lower coupling 212 of the first conduit 201 being stabbed into and sealed with a receiving end 220 of the second coupling, as at 1212.

Further, an upset 260 of the first conduit 201 may be landed on and supported by the upper bracket 232, as at 1214.

Next, a locking member 270 may be employed to maintain a lateral and vertical position of the first conduit 201 relative to the second conduit 202, as at 1216. For example, the locking member 270 may be a pivotal structure that is coupled to the upper bracket 232 and pivoted from an open position to a closed position that spans an open-end of the opening 236. The locking member 270 may engage an upper engaging surface 262 of the upset 260, thereby entraining the upset 260 vertically between the upper bracket 232 and the locking member 270 and laterally within the opening 236. This may prevent displacement of the first conduit 201 relative to the second conduit 202, thereby providing a secure connection therebetween that did not require a threaded engagement therebetween. In some embodiments, an additional threaded coupling or the like could be used to enhance the connection between the first and second conduits 201, 202, but in other embodiments, may be omitted.

The above discussion is meant to be illustrative of the principles and various embodiments of the present disclosure. While certain embodiments have been shown and described, modifications thereof can be made by one skilled in the art without departing from the spirit and teachings of the disclosure. The embodiments described herein are exemplary only and are not limiting.

Accordingly, the scope of protection is not limited by the description set out above, but is only limited by the claims which follow, that scope including all equivalents of the subject matter of the claims.

What is claimed is:

1. A gooseneck conduit assembly for a riser string, comprising:

a first conduit comprising a gooseneck conduit comprising a vertically-extending portion, an upset formed on the vertically-extending portion, an alignment key extending laterally from the vertically-extending portion, and a lower coupling at a lower end of the vertically-extending portion;

a second conduit configured to connect to an auxiliary fluid line connected to and extending along a riser string that extends to a subsea wellhead, the second conduit including a receiving end configured to form a connection with the lower coupling; and a frame configured to be connected to the riser string, wherein the frame comprises:

a lower bracket to which the second conduit is secured;

an upper bracket that is vertically offset from the lower bracket and defines an opening therethrough that is configured to laterally receive the vertically-extending portion of the gooseneck conduit, wherein the upper bracket is configured to engage a lower engaging surface of the upset;

an alignment groove configured to slidably receive the alignment key so as to maintain a coaxial alignment between the vertically-extending portion of the gooseneck conduit and the second conduit; and a locking member pivotally coupled to the upper bracket, wherein the locking member is pivotal between an open position that permits the opening to laterally receive the vertically-extending portion, and a closed position in which the locking member prevents lateral movement of the vertically-extending portion of the gooseneck conduit with respect to the frame, and engages the upset so as to prevent upward movement of the gooseneck conduit with respect to the second conduit, such that a connection between the lower coupling of the gooseneck conduit and the receiving end of the second conduit is maintained without forming a threaded connection therebetween.

2. The gooseneck conduit assembly of claim 1, wherein the lower coupling is configured to be stabbed into the receiving end of the second conduit, and wherein the frame comprises a plurality of upper and lower brackets, wherein pairs of upper and lower brackets are configured to connect together pairs of conduits.

3. The gooseneck conduit assembly of claim 1, wherein the gooseneck conduit and the second conduit are held together in a vertical direction only by the frame, such that the gooseneck is slid vertically into a sealed connection with the second conduit without forming a threaded connection therebetween.

4. The gooseneck conduit assembly of claim 1, wherein the frame comprises a laterally-extending alignment plate configured to direct lateral movement of the gooseneck conduit toward the opening defined by the upper bracket of the frame.

5. The gooseneck conduit assembly of claim 1, wherein the lower coupling comprises a shoulder spaced apart from the lower end of the vertically-extending portion of the gooseneck conduit.

6. The gooseneck conduit assembly of claim 1, wherein the lower coupling of the gooseneck conduit comprises at least one seal positioned therearound.

7. The gooseneck conduit assembly of claim 6, wherein the lower coupling of the gooseneck conduit is tapered so as to provide a stabbing geometry for receipt into the receiving end of the second conduit.

8. The gooseneck conduit assembly of claim 1, wherein the lower coupling of the gooseneck conduit is tapered so as to provide a stabbing geometry for receipt into the receiving end of the second conduit.

9. The gooseneck conduit assembly of claim 1, wherein the lower bracket and the upper bracket of the frame form a coupling module for the first conduit comprising the gooseneck conduit and the second conduit, and wherein the frame comprises a plurality of coupling modules positioned around a central axis of the frame.

* * * * *